US008931613B2

(12) United States Patent
Petermann et al.

(10) Patent No.: US 8,931,613 B2
(45) Date of Patent: Jan. 13, 2015

(54) DEVICE FOR HANDLING NOTES OF VALUE, COMPRISING A STACK MERGING UNIT

(75) Inventors: Udo Petermann, Altenbeken (DE); Paul Freitag, Steinheim (DE); Richard Duesterhus, Paderborn (DE); Hendrik Hoeschen, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/985,849

(22) PCT Filed: Feb. 17, 2012

(86) PCT No.: PCT/EP2012/052762

§ 371 (c)(1),
(2), (4) Date: Sep. 17, 2013

(87) PCT Pub. No.: WO2012/110630

PCT Pub. Date: Aug. 23, 2012

(65) Prior Publication Data

US 2014/0001105 A1 Jan. 2, 2014

(30) Foreign Application Priority Data

Feb. 17, 2011 (DE) ..... 10 2011 000 791

(51) Int. Cl.

| | |
|---|---|
| ***G07F 7/04*** | (2006.01) |
| ***B65H 39/04*** | (2006.01) |
| ***G07D 11/00*** | (2006.01) |
| ***B65H 31/30*** | (2006.01) |
| ***B65H 29/60*** | (2006.01) |
| ***B65H 39/02*** | (2006.01) |

(52) U.S. Cl.

CPC ..... *G07D 11/0021* (2013.01); *B65H 31/3027* (2013.01); *G07D 11/0084* (2013.01); *B65H 29/60* (2013.01); *B65H 39/02* (2013.01); *B65H 2301/42132* (2013.01); *B65H 2301/4217* (2013.01); *B65H 2301/4314* (2013.01); *B65H 2408/11* (2013.01); *B65H 2408/116* (2013.01); *B65H 2408/13* (2013.01)

USPC ..... 194/206

(58) Field of Classification Search

CPC ..... D07D 11/0021; B07C 5/00; B65H 7/02; B65H 29/00; B65H 31/00; B65H 39/04

USPC ..... 194/206, 207; 209/534; 235/379; 270/52.01, 52.02, 52.04, 52.14, 52.19, 270/52.2; 271/1, 147, 265.01; 53/447; 414/789.8, 791; 198/418.4

See application file for complete search history.

(56) References Cited

U.S. PATENT DOCUMENTS 4,905,840 A * 3/1990 Yuge et al. ..... 209/534

(Continued)

FOREIGN PATENT DOCUMENTS

| | | |
|---|---|---|
| DE | 8801544 U1 | 5/1988 |
| DE | 19736453 A1 | 2/1999 |

(Continued)

OTHER PUBLICATIONS

English Translation of the Written Opinion of the ISA for PCT/EP2012/052762, mailed Jul. 24, 2012; ISA/EP, (7 pages).

(Continued)

*Primary Examiner* — Mark Beauchaine

(74) *Attorney, Agent, or Firm* — Harness, Dickey & Pierce, P.L.C.

(57) ABSTRACT

The invention relates to a device (10) for handling notes of value, comprising two intermediate storages (32, 500) for intermediate storage of notes of value and a stack combining unit (802). The stack combining unit (802) combines a first stack formed by notes of value intermediately stored in the first intermediate storage (32) and a second stack formed by notes of value intermediately stored in the second intermediate storage (500) to a single combined stack.

19 Claims, 4 Drawing Sheets

(56) References Cited

U.S. PATENT DOCUMENTS

| | | | | |
|---|---|---|---|---|
| 6,502,052 | B1 * | 12/2002 | Someya et al. | 702/128 |
| 7,954,816 | B2 | 6/2011 | Freitag et al. | |
| 8,340,391 | B2 | 12/2012 | Petermann | |
| 2009/0272795 | A1 | 11/2009 | Stapfer et al. | |
| 2010/0117296 | A1 | 5/2010 | Freitag et al. | |
| 2010/0213023 | A1 | 8/2010 | Freitag et al. | |
| 2012/0211935 | A1 | 8/2012 | Petermann et al. | |
| 2013/0099439 | A1 | 4/2013 | Duesterhus | |

FOREIGN PATENT DOCUMENTS

| | | | |
|---|---|---|---|
| DE | 20312459 | U1 | 12/2004 |
| DE | 10-2006-028633 | A1 | 12/2007 |
| DE | 10-2008-009054 | A1 | 8/2009 |
| DE | 10-2008-039357 | A1 | 2/2010 |
| EP | 1211208 | A1 | 6/2002 |
| EP | 1331189 | B1 | 8/2006 |
| EP | 2101301 | A1 | 9/2009 |
| GB | 2166898 | A | 5/1986 |
| WO | WO-99-28223 | A1 | 6/1999 |

OTHER PUBLICATIONS

International Preliminary Report on Patentability for PCT/EP2012/052762 mailed Aug. 29, 2013 with English translation (17 pages).

* cited by examiner

DEVICE FOR HANDLING NOTES OF VALUE, COMPRISING A STACK MERGING UNIT

CROSS-REFERENCE TO RELATED APPLICATIONS

This application is a National Stage of International Application No. PCT/EP2012/052762, filed Feb. 17, 2012, and published in German as WO 2012/110630 A1 on Aug. 23, 2012. This application claims the benefit and priority of German Application No. 10 2011 000 791.1, filed Feb. 17, 2011. The entire disclosures of the above applications are incorporated herein by reference.

BACKGROUND

This section provides background information related to the present disclosure which is not necessarily prior art.

TECHNICAL FIELD

The invention relates to a device for handling sheet-shaped media, comprising at least two intermediate storages for intermediate storage of sheet-shaped media. The sheet-shaped media are in particular notes of value, such as banknotes and checks.

DISCUSSION

From Document EP 1 331 189 B1 a collecting device for forming and dispensing a stack of sheet-shaped media is known. By means of the collecting device sheet-shaped media received in an intermediate storage can be stacked to form a stack, which can then be dispensed via an output compartment to a user of the device, in which the collecting device is received. A problem of this collecting device is that only individual sheet-shaped media can be supplied thereto, which are then stacked to form a stack. If in case of the device, in which the collecting device is installed, several intermediate storages for intermediate storage of sheet-shaped media, in particular intermediate storages, in which the sheet-shaped media are already received as stack, are provided, several stacks have to be dispensed via the output compartment, in order to dispense all sheet-shaped media received in the intermediate storage to the user. This results in a low operating comfort for the user.

SUMMARY OF THE INVENTION

It is an object of the invention to specify a device for handling sheet-shaped media, which makes dispensing of intermediately stored sheet-shaped media to a user possible and hereby provides an operating comfort being as high as possible for the user.

By providing a stack combining unit, which combines a first stack formed by sheet-shaped media intermediately stored in the first intermediate storage and a second stack formed by sheet-shaped media intermediately stored in the second intermediate storage to a single combined stack, it is achieved that the notes of value intermediately stored in the first and the second intermediate storage can be dispensed in only one combined stack to the user of the device, so that the user only has to remove one stack and thus a high operating comfort is achieved.

The device for handling sheet-shaped media is in particular an automatic cash system, an automatic cash safe and/or an automated teller machine. In particular, both banknotes and checks can be inserted into the device in a single mixed stack. The inserted checks and the admissible banknotes are then intermediately stored in the first intermediate storage and the non-admissible banknotes, damaged bank notes, damaged checks and other sheet-shaped media are intermediately stored in the second intermediate storage.

The device comprises in particular an output unit for dispensing the combined stack to the user of the device. The output unit, via which the stack is dispensed, and an input unit, via which a stack with the sheet-shaped media to be intermediately stored has been inserted before by the user, are in particular designed as a combined input and output unit.

The device has in particular a first stacking unit for stacking sheet-shaped media removed from the first intermediate storage to form the first stack and/or a second stacking unit for stacking sheet-shaped media removed from the second intermediate storage to form the second stack. In this case, the sheet-shaped media are respectively received individually in the respective intermediate storage and are only stacked to form the respective stack after they have been removed from the respective intermediate storage. The first intermediate storage and/or the second intermediate storage are in particular a drum module in which the sheet-shaped media are received wound up between foil tapes. By means of the respective stacking unit the first, or, respectively, the second stack can then be formed therefrom in an easy manner. By means of the stack combining unit the two stacks can be united to one stack, so that only this united stack has to be dispensed.

In particular, a first transport unit is provided, which supplies the sheet-shaped media received in the first intermediate storage individually to the first stacking unit. After stacking the sheet-shaped media to form the first stack, a second transport unit transports the first stack from the first stacking unit to the stack combining unit.

In a particularly preferred embodiment of the invention, the sheet-shaped media intermediately stored in the first intermediate storage are already received as first stack in the first intermediate storage and/or the sheet-shaped media intermediately stored in the second intermediate storage are already received as second stack in the second intermediate storage. In this case, the media intermediately stored in the respective intermediate storage do not first need to be stacked to form the respective stack after the individual removal via a stacking unit, but can be removed as stack from the respective intermediate storage and be transported to the stack combining unit, which then unites the two stacks to the combined stack.

In a particularly preferred embodiment of the invention, the first intermediate storage is designed as drum module, in which the sheet-shaped media are individually received, and the second intermediate storage is designed such, that the sheet-shaped media received therein are already stored as second stack. The sheet-shaped media stored in the drum module are supplied to the first stacking unit, which forms the first stack therefrom. Subsequently, the second stack removed from the second intermediate storage and the first stack are transported to the stack combining unit and united to the combined stack.

The device preferably comprises a sensor unit for determining at least one feature of each sheet-shaped medium supplied to the device. Dependent on this determined feature of the sheet-shaped medium a control unit classifies the sheet-shaped media into admissible sheet-shaped media and sheet-shaped media to be re-dispensed and controls a sorting gate such that this sorting gate supplies sheet-shaped media classified as admissible sheet-shaped media to the first intermediate storage and sheet-shaped media classified as sheet-shaped media to be re-dispensed to the second intermediate storage. Thus, a division of the sheet-shaped media dependent on the classification is achieved. As features e.g. the presence of magnetic information, water marks, dimensions of the sheet-shaped media and/or characteristic features for specific types of notes of value are determined. The sensor unit comprises in particular a picture detection unit, which detects at least one picture showing an image of each supplied sheet-shaped medium. In the control unit at least one image processing algorithm is stored, which is executed by the control unit, wherein the control unit thus determines at least one feature of the sheet-shaped medium. The admissible sheet-shaped media are in particular admissible banknotes, i.e. banknotes of a preset currency, and checks. In contrast, non-admissible banknotes, i.e. banknotes of an other than the preset currency, damaged banknotes, damaged checks and/or other sheet-shaped media, e.g. business cards and the like are classified as sheet-shaped media to be re-dispensed.

The second intermediate storage is in particular designed such that the sorting gate supplies the sheet-shaped media classified as sheet-shaped media to be re-dispensed at a first position to the second intermediate storage and a further sorting gate removes in a removal sorting gate position the sheet-shaped media received in the second intermediate storage at a second position different from the first position from the second intermediate storage. In case that the notes of value are intermediately stored in the second intermediate storage individually, the further sorting gate supplies the removed notes of value individually to the second stacking unit, which forms a second stack from the removed notes of value. If the notes of value are, however, already received in the second intermediate storage as second stack, the further sorting gate directs the second stack out of the second intermediate storage and guides the second stack to the stack combining unit.

The second intermediate storage comprises in particular at least two circumferential belts, between which the second stack is received and by which the second stack is constantly transported in a circumferential direction. Thus, a particular simple and compact structure is achieved. The further sorting gate engages in the removal sorting gate position in the circumferential transport path, along which the second stack is transported, and thus directs the second stack out of the circumferential transport path.

The device in particular has an input compartment for the insertion of a stack of sheet-shaped media and a separating unit for separating the sheet-shaped media of the inserted stack. The separated sheet-shaped media are classified by means of the sensor unit and the control unit and dependent on their classification received in the first intermediate storage or the second intermediate storage. After all sheet-shaped media of the inserted note of value stack have been received in one of the two intermediate storages at least one information about the sheet-shaped media intermediately stored in the first intermediate storage is displayed to the user via a display unit. Preferably, the number of the sheet-shaped media intermediately stored in the first intermediate storage and/or the sum of all values of the sheet-shaped media intermediately stored in the first intermediate storage is displayed to the user. Dependent on an information entered via an input unit by the user the control unit either executes a re-dispensing process or a depositing process. The re-dispensing process is in particular executed, when the user enters a negative information, or, respectively, no entry is made at all within a preset time interval. In this case, in a re-dispensing process both the sheet-shaped media intermediately stored in the first intermediate storage and in the second intermediate storage are re-dispensed to the user, wherein before the dispensing the first stack and the second stack are combined to the combined stack, so that only one combined stack is dispensed via the output unit to the user.

If the user, however, confirms the displayed information, the depositing process is executed. In this depositing process the sheet-shaped media intermediately stored in the first intermediate storage are transported individually in a safe of the device, in which at least one value note cassette is received, in which the sheet-shaped media are deposited. The sheet-shaped media, which are intermediately stored in the second intermediate storage, are, in contrast, re-dispensed to the user as second stack.

The stack combining unit preferably has a first support element, on which the first stack is at least partially supported during the supply and/or a second support element, on which the second stack is at least partially supported during the supply. Thus, it is achieved that both stacks are securely guided, so that value note jams and/or slipping of the sheet-shaped media of a stack relative to each other are prevented.

The second support element divides in particular the first and the second stack from each other. For this, the two support elements are in particular arranged in a preset distance with respect to each other, so that a kind of compartment is formed between the two support elements, in which the first stack is received.

The two note of value stacks are, when they are supported on the first or, respectively, the second support element, in particular arranged such that their notes of value are arranged approximately horizontally, so that the notes of value securely lie on top of each other and the stacks are maintained. Hereby, in particular, the topmost sheet-shaped medium of the first stack faces a first side of the second support element. The lowermost sheet-shaped medium of the second stack, which is supported on the second support element, faces a second side, opposite to the first side, of the second support element and contacts this second side.

Further, it is advantageous, when the stack combining unit comprises a first transport element for the transport of the first stack supported on the first support element into a combining direction and a second transport element for the transport of the second stack supported on the second support element in the combining direction. The second transport element hereby pushes the stack supported on the second support element in the combining direction from the second support element, so that this stack slides onto the first stack having also been moved in the combining direction by the first transport element, until the two stacks are lying on top of each other and thus form the combined stack. Thus, a combined stack is formed in an easy manner without a complex structure being required therefor.

The first transport element and/or the second transport element comprise respectively at least one vane wheel, at least one roller and/or at least one belt, via which the first stack or, respectively, the second stack are moved in the combining direction. The two transport elements are in particular driven via the same drive unit, so that it is ensured, that they are driven continuously and the two stacks are transported with the same speed in the combining direction. Thus, it is achieved that the two value note stacks are actually supported on one another, when the second stack is not supported on the second support element anymore.

The combined stack is formed such that the sheet-shaped medium, which contacted the second support element before, now contacts the sheet-shaped medium of the first stack, which faces away from the first support element.

Further, the first support element and/or the second support element can be movable pivotally and/or translationally. In particular, the two support elements can be movable towards each other, so that the distance between the two stacks is reduced and a secure combining is achieved. In particular, the distance between the two support elements is changed for combining dependent on the thickness of the first note of value stack. For this, the first support element is preferably supported via a spring, which biases the first support element and the first stack supported thereon in the direction of the second support element and which is elastically deformed due to the weight of the first stack against its spring force. Thus, the distance between the first support element and the second support element is the greater the heavier the first stack is and the more sheet-shaped media are comprised in the first stack.

The supply direction is preferably directed approximately transversely to the normal vector of the plane which is defined by the sheet-shaped medium of the first stack contacting the first support element and/or approximately transversely to the normal vector of the plane which is defined by the sheet-shaped medium of the second stack contacting the second support element. Thus, a secure and easy combining of the two stacks is achieved.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
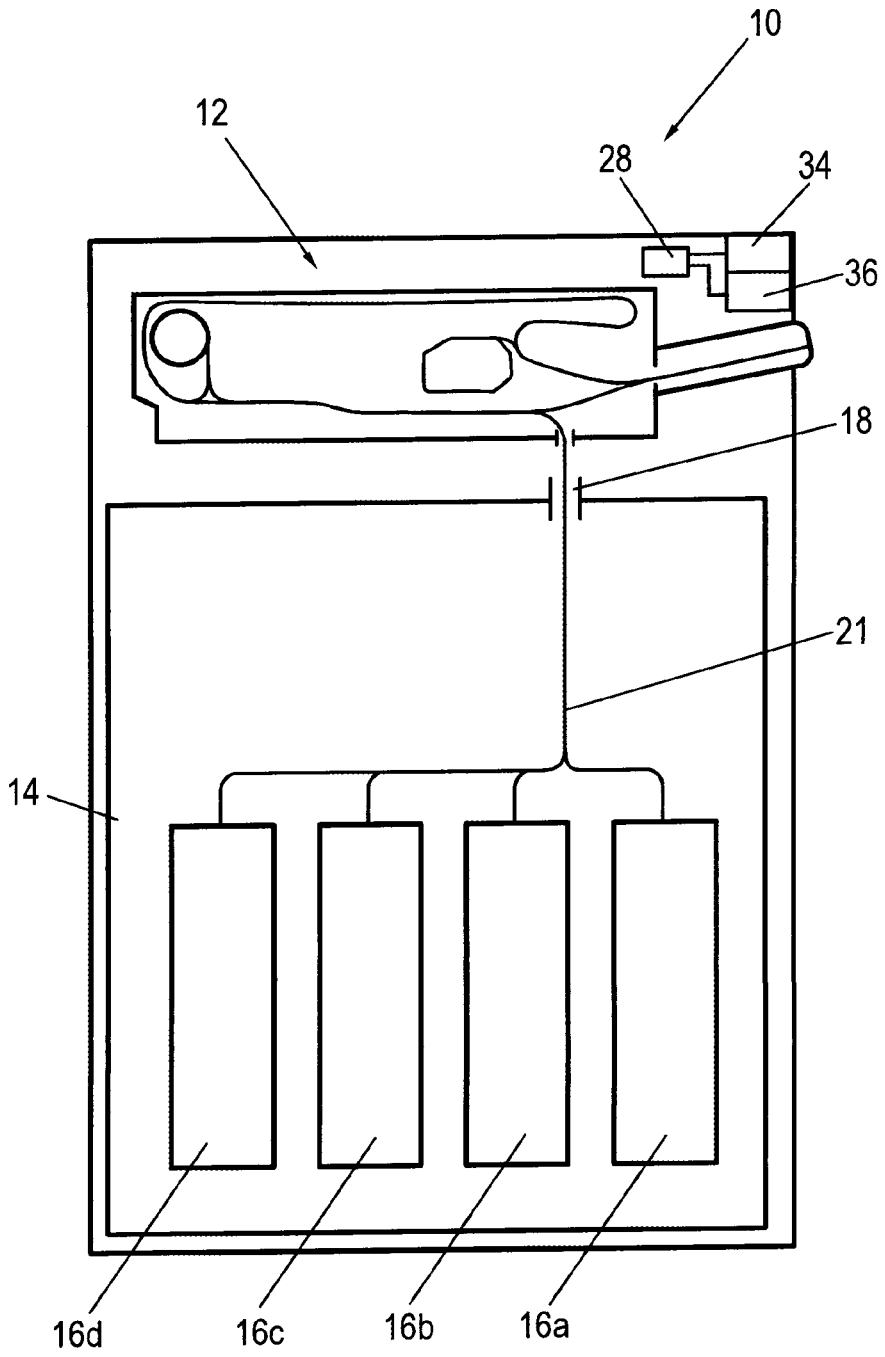
FIG. 1 shows a schematic illustration of a device for handling notes of value.

In FIG. 1, a schematic illustration of a device 10 for handling notes of value is illustrated. The device 10 is in particular an automatic cash safe, an automatic cash system and/or an automated teller machine, such as a deposit machine for depositing banknotes and checks.

The device 10 comprises a head module 12 and a safe 14. The structure of the head module 12 is described in more detail in connection with FIG. 2. In the safe 14, four value note cassettes 16*a* to 16*d* are arranged in which the notes of value can be received. Hereby, in particular one of the value note cassettes 16*a* to 16*d* is provided for receiving checks and the other three value note cassettes 16*a* to 16*d* are provided for receiving banknotes. The banknotes are in particular received in a type-specific manner, i.e. in one value note cassette 16*a* to 16*d* always only banknotes of one denomination are received. Alternatively, also a mixed storage may be realized, i.e. in one value note cassette 16*a* to 16*d* notes of value of different denominations are received in a mixed manner. In an alternative embodiment, also more than four or less than four, in particular two, value note cassettes 16*a* to 16*d* can be provided in the safe 14. In particular, a so-called reject cassette can be provided in which notes of value are received that are suspected of being counterfeit and/or include damages. In a preferred embodiment, two value note cassettes 16*a* to 16*d*, namely one for receiving checks and one for receiving banknotes, are provided.

Hereby, the notes of value can be received in the value note cassettes 16*a* to 16*d* in a stacked manner in a reception area as well as wound up between two foil tapes onto a drum module. Different types of value note cassettes can also be used within the safe 14.

In the present embodiment, the device 10 is designed as a mere depositing device in which notes of value can only be received. Alternatively, it can also be designed as a recycling device into which notes of value can both be inserted and be re-dispensed therefrom.

The safe 14 includes a transfer slot 18 through which the notes of value are supplied from the head module 12 to the safe 14. From the transfer slot 18, the notes of value are transported via a transport unit identified with the reference sign 21 to the value note cassettes 16*a* to 16*d*.

Figure 2:
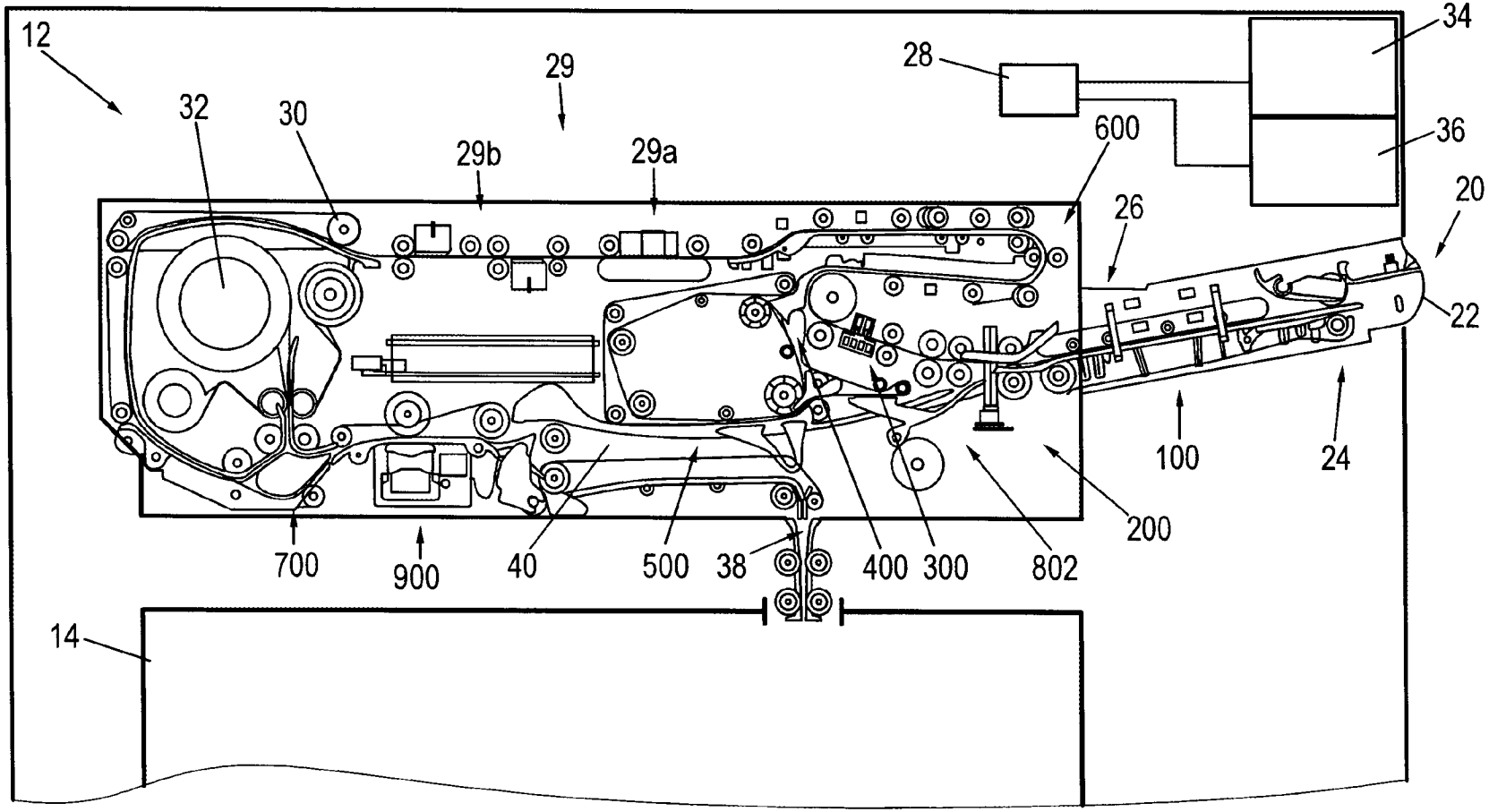
FIG. 2 shows a schematic illustration of a head module of the device according to FIG. 1.

In FIG. 2, a schematic illustration of the head module 12 according to FIG. 1 is shown. The head module 12 includes an input and output unit 20 via which the notes of value can be inserted in the form of a value note stack. Further, via this input and output unit 20 individual notes of value and/or value note stacks can also be re-dispensed to the user of the device 10. The input and output unit 20 in particular includes a so-called shutter 22 via which an opening for supplying and dispensing the notes of value can be opened and closed.

A value note stack inserted via the input and output unit 20 is transported to a first aligning unit 100 by means of a transport unit 24. By means of the first aligning unit 100, the notes of value of the value note stack are aligned in a preset alignment or at least the alignment of a part of the notes of value of the value note stack is changed such that it is approximated to the preset alignment. By means of a transport unit 26, the aligned value note stack is supplied to a separating unit 200 which separates the notes of value of the value note stack and supplies the separated notes of value to a first sensor unit 300.

The first sensor unit 300 comprises a picture capturing unit by means of which at least one picture with an image of this note of value is taken of each supplied note of value. Dependent on the image of the note of value, a control unit 28 of the device 10 determines at least one feature of the note of value in the picture and, dependent on this feature, classifies the note of value into checks, banknotes of a preset currency and other sheet-shaped media. The other sheet-shaped media can, for example, be notes of value of another currency than the preset one and/or other sheet-shaped media which were erroneously inserted by the user of the device. For example, these can be business cards or account statements. The preset currency is in particular the currency that is to be handled by means of the device 10, in particular that is to be received in the value note cassettes 16*a* to 16*d*.

Those notes of value that were neither classified as checks nor as banknotes of the preset currency will be transported via a sorting gate 400 into a second intermediate storage 500 for the intermediate storage of sheet-shaped media and will be intermediately stored therein preferably as second value note stack. The checks and the banknotes of the preset currency, on the other hand, are supplied via the sorting gate 400 to a second aligning unit 600. By means of this second aligning unit 600 the checks are aligned in a first preset target alignment and the banknotes are aligned in a second target alignment differing from the first target alignment. In particular, several different target alignments for banknotes of different denominations are preset and the second aligning unit 600 aligns the notes of value not only in different preset target alignments dependent on whether checks or banknotes are concerned, but additionally also dependent on the denomination of the banknotes.

The aligned notes of value are then supplied to a second sensor unit 29 by means of which the authenticity of the banknotes is determined and by means of which magnetic information of the checks is read out. The sensor unit 29 comprises a banknote sensor unit 29*a* by means of which the authenticity of the banknotes is verified and a check sensor unit 29*b* by means of which the authenticity of the checks is verified and information printed on the checks is read out. The first sensor unit 300 and the second sensor unit 29 form together with the control unit 28 in particular a non-counterfeit money and check detection module. In the determination of the authenticity of the banknotes and/or checks preferably also information determined by means of the sensor unit 300 is taken into account.

Subsequently, the notes of value are transported in the direction of a second sorting gate 700 by means of further transport elements, one of which is exemplarily identified with the reference sign 30. Via the second sorting gate 700, all notes of value of the previously inserted value note stack which were classified as checks or banknotes of the preset currency, are at first supplied to a first intermediate storage 32 and intermediately stored therein. The intermediate storage 32 is in particular designed in the form of a drum module in which the notes of value to be received are received in a wound up manner between two foil tapes. After all notes of value of the inserted value note stack are received in the first intermediate storage 32 or the second intermediate storage 500, at least one information about the notes of value received in the first intermediate storage 32 and/or in the second intermediate storage 500 is output to the user via a display unit 34. This information in particular comprises information about the number of the inserted notes of value and/or the value of the sum of the denominations of the inserted notes of value that are received in the first intermediate storage 32. Further, the user is in particular asked to enter a confirmation information via an input unit 36.

When no confirmation information is entered via the input unit 36 by the user within a preset time interval after request and/or when the user makes a negative entry, then the notes of value received in the first intermediate storage 32 are transported out of this intermediate storage 32 and are supplied to a stacking unit 40, by means of which a first value note stack is formed from all notes of value received in the first intermediate storage 32. Further, the second value note stack received in the second intermediate storage 500 is removed from the second intermediate storage 500. Both the first value note stack and the second value note stack are supplied to a stack combining unit 802 by means of which a single combined value note stack is formed from the first and the second value note stack. This combined value note stack is then re-dispensed to the user via the input and output unit 20.

When, on the other hand, the user enters the confirmation information within the preset time interval after the respective request, then the second value note stack is removed from the second intermediate storage 500 and is dispensed to a user via the input and output unit 20.

The notes of value intermediately stored in the first intermediate storage 32, on the other hand, are supplied along a transport path 38 to the safe 14 and are received in the value note cassettes 16*a* to 16*d*. Before they are transported into the safe 40, the checks intermediately stored in the first intermediate storage 32 are cancelled in that a cancellation print image is printed onto a preset print area of the check. For this, a printing unit 900 for printing the checks is provided between the second sorting gate 700 and the transport path 38. Via the sorting gate 700, the checks are hereby supplied to the printing unit 900 such that the printing area on which the cancellation information is to be printed faces the print head of the printing unit 900 so that the print head can print the cancellation print image onto this printing area.

By means of the afore-described head module 12, it is achieved that in one device 10 checks and banknotes can be handled together and these can be supplied to the device 10 in an arbitrarily mixed manner in one stack. In this way, a particularly high operating comfort is achieved for a user of the device 10 as the user does not have to manually presort the notes of value into checks and banknotes nor does the user have to preset which type of notes of value is supplied, as is the case in known devices.

Figure 3:
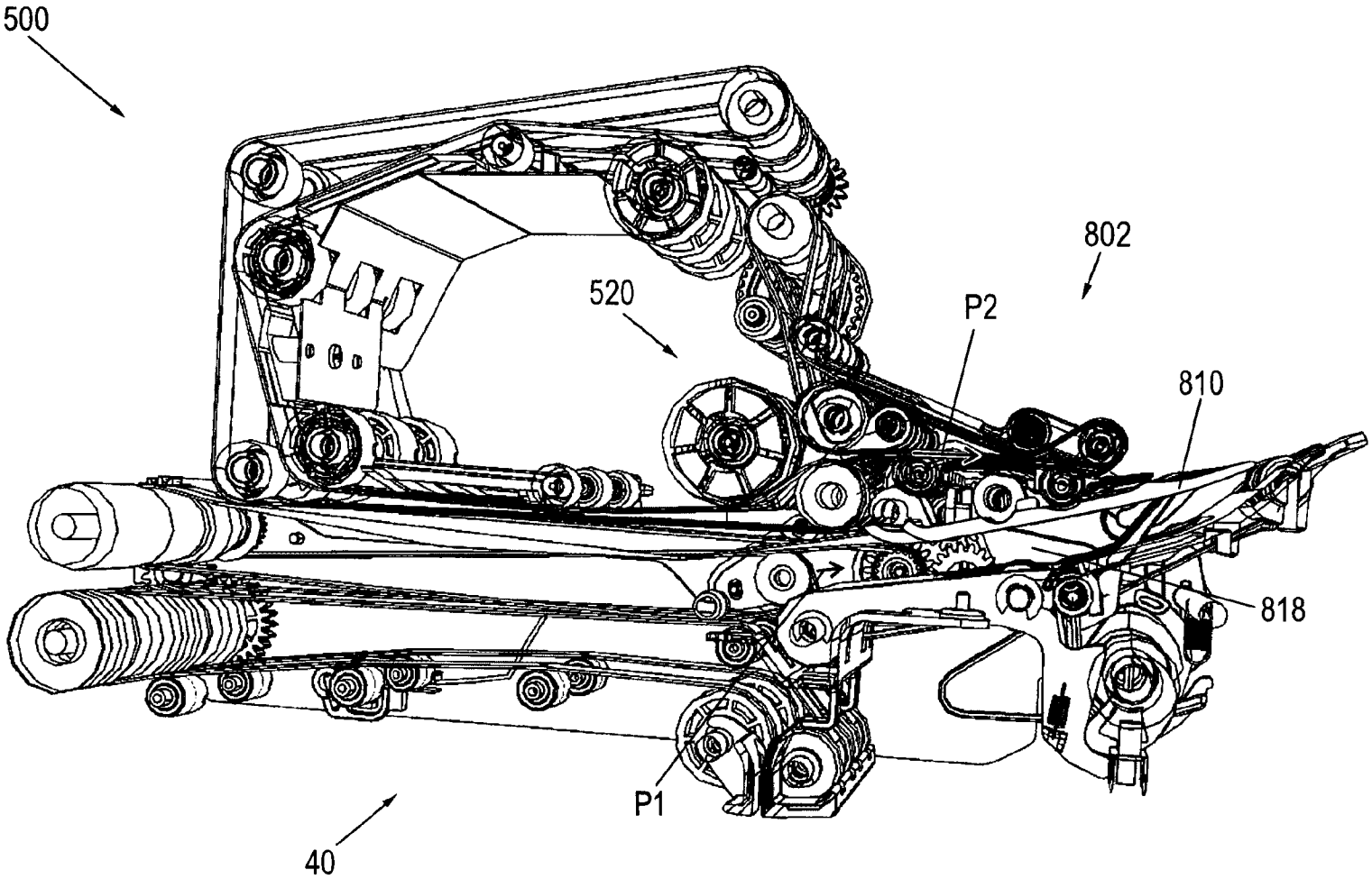
FIG. 3 shows a sectional illustration of an intermediate storage and a stack combining unit of the head module according to FIG. 2.
Figure 4:
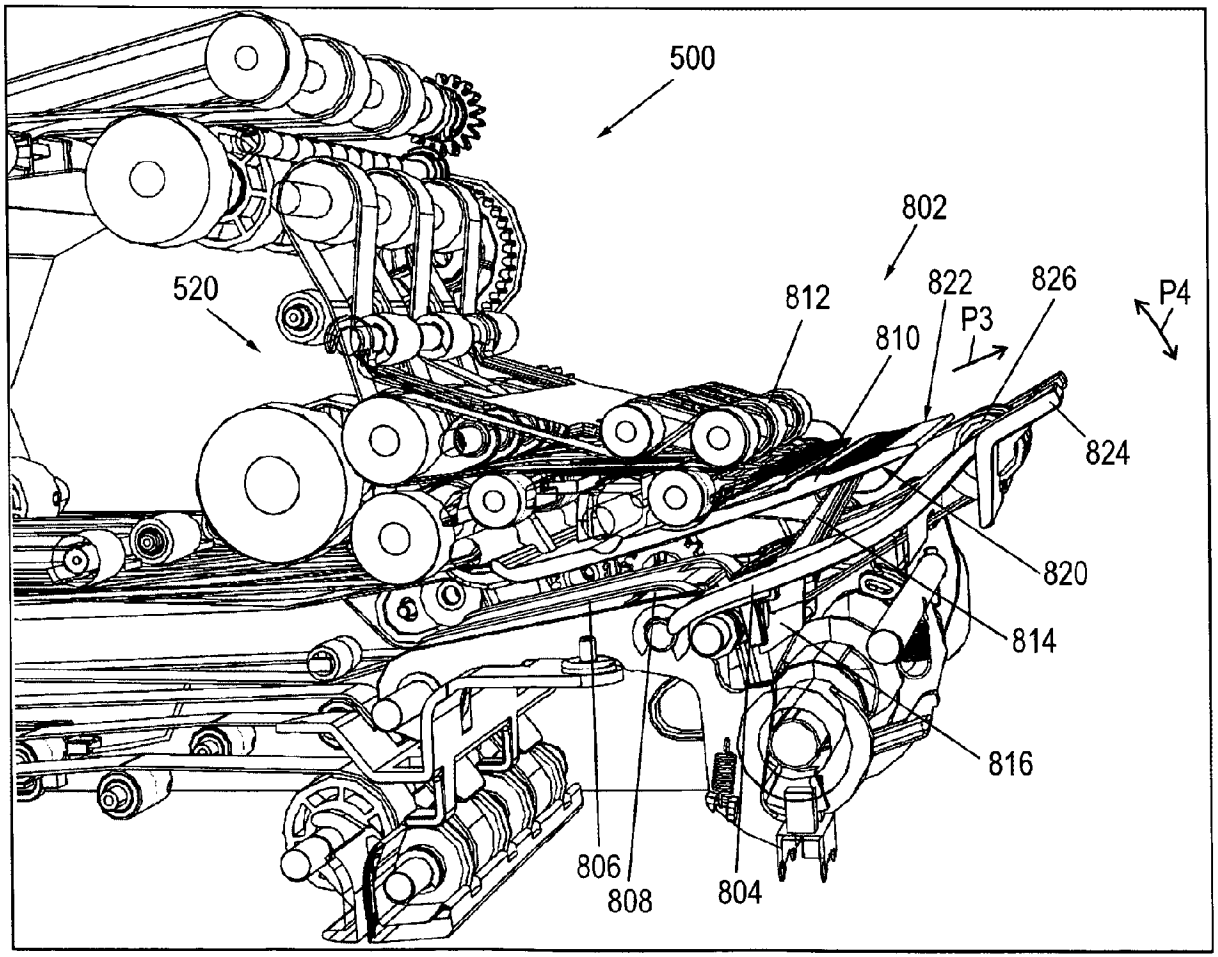
FIG. 4 shows a further sectional illustration of the intermediate storage and the stack combining unit according to FIG. 3.

In FIG. 3, a schematic, perspective sectional illustration of the second intermediate storage 500 and the stack combining unit 802 is illustrated. FIG. 4 shows a further sectional illustration of the second intermediate storage 500 and the stack combining unit 802.

When no confirmation information is entered by the user, as described above, within the preset time interval or when a negative information is entered then the sheet-shaped media intermediately stored in the first intermediate storage 32 are stacked to form the first stack via the stacking unit 40. This first stack is supplied to the stack combining unit 802 in the direction of the arrow P1 and is hereby supported at least partially on a first support element 800 of the stack combining unit 802. The stack combining unit 802 comprises several belts 806 mounted and driven via rollers 808, by means of which the first stack is transportable in the direction of the arrow P1.

The sheet-shaped media intermediately stored in the second intermediate storage 500 are already intermediately stored in the second intermediate storage 500 as second stack and are removed from the second intermediate storage 500 via the sorting gate 520 and supplied to the stack combining unit 802 in the direction of the arrow P2. The stack combining unit 802 comprises a second support element 810 on which the supplied second stack is at least partially supported. Further, the stack combining unit 802 has further driven belts 812, by means of which the second stack is transported in the direction of the arrow P2.

The belts 806 for the transport of the first stack and the belts 812 for the transport of the second stack are in particular drivable via the same drive unit, so that they are driven with the same speed and the two stacks to be combined are transported with the same speed in the direction of the arrows P1 or, respectively, P2 and thus towards each other.

In an alternative embodiment of the invention, the sheet-shaped media intermediately stored in the second intermediate storage 500 can also be received therein individually or only partially arranged in an overlapping fashion. In this case, a further stacking unit is arranged between the second intermediate storage 500 and the stack combining unit 802, which first stacks the sheet-shaped media removed from the second intermediate storage 500 to form the second stack, before this second stack is then transported to the stack combining unit 802, which then combines the first and the second stack to the combined stack.

Between the first support element 804 and the second support element 810 a compartment 818 is formed, in which the first stack is at least partially received during combining of the stacks. Several guiding fingers 814 project into this compartment 818, which are biased via elastic elements, e.g. springs 816, in the direction of the second support element 810. Via the guiding fingers 814 a first stack supplied in the direction of the arrow P1 is guided away from the first support element 804 in the direction of the second support element 810. Thus it is achieved that a sheet-shaped medium, facing the second support element 810, of the first stack contacts a first side 820 of the second support element 810. In contrast, the sheet-shaped medium, facing the second support element 810, of the second stack contacts the second support element 810 at the side 822 opposite to the first side 820. Thus, the two stacks bear against opposite sides of the second support element 810 during combining, so that during the transport in the combining direction P3 the two stacks slide onto one another and thus form the combined stack. In this combined stack, the sheet-shaped medium, which has contacted the first side 820 before, and the sheet-shaped medium, which has contacted the second side 822 before, contact each other. The combining direction P3 is preferably directed approximately in the direction of the first side 820 and/or the second side 822 of the second support element 810.

The combined stack is at least partially supported with the side, which has contacted the first support element 804 before, on a guiding element 824 and on rollers 826 mounted thereon, so that it can be further transported in the direction of the input and output unit 20. This guiding element 824 is pivotally mounted via elastic elements, e.g. at least one spring, transversely to the combining direction P3 in the direction of the arrow P4, so that by the respective pivoting dependent on the number of the sheet-shaped media a uniform transport in the direction P3 is guaranteed due to the weight of the sheet-shaped media and the alignment of the guiding element 824 adapts to the number of sheet-shaped media of the combined stack.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for handling sheet-shaped media, in particular notes of value, comprising:

a first intermediate storage for intermediate storage of sheet-shaped media, a second intermediate storage for intermediate storage of sheet-shaped media, a stack combining unit for combining a first stack formed by sheet-shaped media intermediately stored in the first intermediate storage and a second stack formed by sheet-shaped media intermediately stored in the second intermediate storage to a single combined stack;

wherein a first stacking unit for stacking sheet-shaped media removed from the first intermediate storage to form the first stack and/or a second stacking unit for stacking sheet-shaped media removed from the second intermediate storage to form the second stack is/are provided; and wherein a first transport unit transports the sheet-shaped media removed from the first intermediate storage individually to the first stacking unit, and that a second transport unit transports the first stack from the first stacking unit to the stack combining unit.

2. The device according to claim 1, wherein an output unit for dispensing the combined stack to a user of the device is provided.

3. The device according to claim 1, wherein the sheet-shaped media intermediately stored in the first intermediate storage are received as first stack in the first intermediate storage and/or the sheet-shaped media intermediately stored in the second intermediate storage are received as second stack in the second intermediate storage.

4. The device according to claim 1, wherein an input unit for the insertion of a stack of sheet-shaped media and a separating unit for the separation of the sheet-shaped media of this stack are provided.

5. The device according to claim 4, wherein after all sheet-shaped media of the inserted stack have been received dependent on their classification in the first intermediate storage and the second intermediate storage, a display unit displays information on the sheet-shaped media intermediately stored in the first intermediate storage to the user, and that dependent on an information entered via an input unit by the user the control unit either executes a re-dispensing process, in which the stack combining unit combines the first stack and the second stack and the output unit dispenses the combined stack to the user, or executes a depositing process, in which the output unit only dispenses the second stack to the user, and in which the sheet-shaped media intermediately stored in the first intermediate storage are transported individually into at least one value note cassette (16*a* to 16*d*).

6. The device according to claim 1, wherein a sensor unit for determining at least one feature of each sheet-shaped medium is provided, that a control unit is provided, which classifies the sheet-shaped media dependent on the determined feature into admissible sheet-shaped media and sheet-shaped media to be re-dispensed, that a sorting gate is provided, which is connected via a first transport path with the sensor unit, and that the control unit controls the sorting gate such that the sorting gate supplies a sheet-shaped medium classified as admissible sheet-shaped medium to the first intermediate storage and supplies a sheet-shaped medium classified as sheet-shaped medium to be re-dispensed to the second intermediate storage.

7. The device according to claim 6, wherein the sorting gate is connected via a second transport path with the first intermediate storage and via a third transport path with the second intermediate storage, and that the control unit controls the sorting gate such, that the sorting gate directs a sheet-shaped medium classified as admissible sheet-shaped medium from the first transport path in the second transport path, and that the sorting gate directs a sheet-shaped medium classified as sheet-shaped medium to be re-dispensed from the first transport path in the third transport path.

8. The device according to claim 6, wherein the sorting gate supplies the sheet-shaped media classified as sheet-shaped media to be re-dispensed at a first position of the second intermediate storage to the second intermediate storage, and that a further sorting gate is provided, which in a removal sorting gate position directs the sheet-shaped media received in the second intermediate storage at a second position of the second intermediate storage different from the first position out of the second intermediate storage.

9. The device according to claim 6, wherein the control unit classifies banknotes of a preset currency and checks as admissible sheet-shaped media, and that the control unit classifies all other sheet-shaped media as sheet-shaped media to be re-dispensed.

10. The device according to claim 1, wherein the stack combining unit includes a first support element, on which the first stack is at least partially supported during combining, and/or a second support element, on which the second stack is at least partially supported during combining.

11. The device according to claim 10, wherein the second support element divides the first stack and the second stack from each other.

12. The device according to claim 10, wherein with the combined stack the sheet-shaped medium, which contacted the second support element, contacts the sheet-shaped medium of the first stack, which is arranged at the front side of the first stack opposite to the front side of the first stack, which contacted the first support element.

13. The device according to claim 10, wherein the first support element and/or the second support element are movable pivotally and/or translationally for combining the first stack and the second stack.

14. The device according to claim 10, wherein a first transport element is provided for the transport of the first stack, supported on the first support element, in a combining direction, that a second transport element is provided for the transport of the second stack, supported on the second support element, in the combining direction, and that the second transport element pushes the second stack from the second support element, so that the second stack slides onto the first stack having been moved in the combining direction by the first transport element.

15. The device according to claim 14, wherein the first transport element and/or the second transport element comprise respectively at least one vane wheel, at least one roller and/or at least one belt.

16. The device according to claim 14, wherein the first transport element transports the first stack and the second transport element transports the second stack at the same speed in the combining direction.

17. The device according to claim 14, wherein the supply direction is directed approximately transversely to the normal vector of the plane, which is defined by the sheet-shaped medium, contacting the first support element, of the first stack, and/or approximately transversely to the normal vector of the plane, which is defined by the sheet-shaped medium, contacting the second support element, of the second stack.

18. A device for handling sheet-shaped media, in particular notes of value, comprising:

a first intermediate storage for intermediate storage of sheet-shaped media, a second intermediate storage for intermediate storage of sheet-shaped media, a stack combining unit for combining a first stack formed by sheet-shaped media intermediately stored in the first intermediate storage and a second stack formed by sheet-shaped media intermediately stored in the second intermediate storage to a single combined stack; and wherein a sensor unit for determining at least one feature of each sheet-shaped medium is provided, that a control unit is provided, which classifies the sheet-shaped media dependent on the determined feature into admissible sheet-shaped media and sheet-shaped media to be re-dispensed, that a sorting gate is provided, which is connected via a first transport path with the sensor unit, and that the control unit controls the sorting gate such that the sorting gate supplies a sheet-shaped medium classified as admissible sheet-shaped medium to the first intermediate storage and supplies a sheet-shaped medium classified as sheet-shaped medium to be re-dispensed to the second intermediate storage.

19. A device for handling sheet-shaped media, in particular notes of value, comprising:

a first intermediate storage for intermediate storage of sheet-shaped media, a second intermediate storage for intermediate storage of sheet-shaped media, a stack combining unit for combining a first stack formed by sheet-shaped media intermediately stored in the first intermediate storage and a second stack formed by sheet-shaped media intermediately stored in the second intermediate storage to a single combined stack, wherein the stack combining unit includes a first support element, on which the first stack is at least partially supported during combining, and/or a second support element, on which the second stack is at least partially supported during combining, and wherein a first transport element is provided for the transport of the first stack, supported on the first support element, in a combining direction, that a second transport element is provided for the transport of the second stack, supported on the second support element, in the combining direction, and that the second transport element pushes the second stack from the second support element, so that the second stack slides onto the first stack having been moved in the combining direction by the first transport element.

* * * * *